US006616088B2

(12) United States Patent
Lintelmann et al.

(10) Patent No.: US 6,616,088 B2
(45) Date of Patent: Sep. 9, 2003

(54) DEVICE FOR STORING AND UNWINDING ROLLS OF MATERIAL IN BOOKBINDING MACHINES

(75) Inventors: Gerhard Lintelmann, Rahden (DE); Günter Geldmeier, Stemwede-Oppendorf (DE)

(73) Assignee: Kolbus GmbH & Co. KG, Rahden (DE)

( * ) Notice: Subject to any disclaimer, the term of this patent is extended or adjusted under 35 U.S.C. 154(b) by 0 days.

(21) Appl. No.: 09/989,234

(22) Filed: Nov. 19, 2001

(65) Prior Publication Data

US 2002/0060266 A1 May 23, 2002

(30) Foreign Application Priority Data

Nov. 21, 2000 (DE) ..... 100 57 597

(51) Int. Cl.[7] ..... B65H 19/18
(52) U.S. Cl. ..... 242/560; 242/551; 242/564.5
(58) Field of Search ..... 242/560, 560.1, 242/551, 555.1, 555.3, 555, 554, 563, 564.5, 566

(56) References Cited

U.S. PATENT DOCUMENTS 2,721,709 A * 10/1955 Auerbacher ..... 242/560.1
3,365,144 A * 1/1968 Daub ..... 242/551
3,702,672 A * 11/1972 Becht ..... 242/560
3,779,473 A * 12/1973 Edrinn ..... 242/564.5
3,955,772 A * 5/1976 Chisholm et al. ..... 242/564.5
4,113,197 A 9/1978 Harrington et al.
5,279,471 A 1/1994 Peters
5,302,167 A * 4/1994 Kley et al. ..... 242/560.1
5,318,646 A 6/1994 Cardini et al. ..... 156/157
5,377,586 A * 1/1995 Matsuno ..... 242/551
5,820,067 A * 10/1998 Orbons et al. ..... 242/560

FOREIGN PATENT DOCUMENTS

DE 29 48 169 C2 3/1991
DE 36 14 221 C2 2/1995

OTHER PUBLICATIONS

German Search Report dated Nov. 19, 2001.

* cited by examiner

*Primary Examiner*—William A. Rivera
(74) *Attorney, Agent, or Firm*—Alix, Yale & Ristas, LLP

(57) ABSTRACT

A device for storing and unrolling materials in web form in bookbinding machines having a roll-changing device for connecting a material which is to be unwound from a roll to the end of a material of the same kind unwound from another roll. The two rolls of material are placed, resting on their superficies, in an almost perpendicular shaft and are supported and guided on side walls of the shaft via their end faces. The roll of material to be stored rests on a stationary, almost horizontal floor. The unwinding roll of material rests on movable supporting elements which are set in motion, during the unrolling of the roll of material, when the latter is supported against supporting rollers forming one end face of the shaft.

12 Claims, 4 Drawing Sheets

1
2
3
4
5
6
7
8
9 a,b
10
11
13
14
15
16
17
18
19
21
22
23
24
24a
24b
25
26
27
28
29
A 8
9 a.b
10
11
13
14
15
16
17
18
19
21
22
23
24
25
26
27
28
1
2
3

DEVICE FOR STORING AND UNWINDING ROLLS OF MATERIAL IN BOOKBINDING MACHINES

BACKGROUND OF THE INVENTION

The invention relates to a device for storing and unwinding rolls of material in bookbinding machines.

In many production processes in the manufacture of bookbinding products, materials in web form are processed which, unwound endlessly from a roll, are fed to the production process either in a timed manner or continuously, and are cut off to the required length at the moment of joining or immediately before it. For the continuous processing of such rolls of material, roll-changing devices are known which connect the end of a web of material unwound from one roll of material to the beginning of a web of material of the same kind which is to be unwound from another roll of material.

By way of an example, DE 36 14 221 describes such a roll-changing device for webs of screening material, in which the two webs of material are connected to one another with the aid of an adhesive tape which overlaps the join between the ends of the webs. Before the roll-changing operation, the beginning of the web of material to be unwound from a roll of material is clamped-in in a gripping device above the path of movement of the web of material drawn off, cut off in a straight manner at a cutting edge which defines the line of the join, and provided with an adhesive tape which protrudes at the beginning of the web of material. At the moment the roll-changing operation occurs, the gripping device travels downwards, with the web of material which is to be unwound and which is held in a clamped-in manner, into the plane of the unwound web of material, at the same time severs the unwound web of material in a straight manner against a supporting table with the aid of the cutting edge, and immediately afterwards touches down, with the protruding adhesive tape, on the end of the unwound web of material. After the adhesive tape has been firmly pressed on, the gripping device releases the web of material to be unwound, elements on the said gripping device below the path of movement of the web of material are pivoted out sideways, and the gripping device travels back upwards into the starting position.

The rolls of material are located on roll-mountings which hold the core of the roll, in order to permit low-resistance unwinding of the web of material by a system of drawing-off rollers. Under these circumstances, the end faces of, in particular, narrow rolls of material are supported by metal side plates. In the event of interruptions in the drawing-off of the web of material, the rolls of material have to be braked so that they do not continue to unwind automatically because of rotational energy. To that end, the metal side plates are pressed against the end faces of the surfaces of the material by the application of a pneumatically generated force at the moment of braking, or of a constantly applied spring force. What is common to both solutions is that the braking force is constant and is not proportional to the mass moment of inertia to be braked. That is to say, a roll of material with a large outer diameter and thereby a large mass moment of inertia is, under certain circumstances, braked in too weak a manner, whereas a small roll of material is braked in too strong a manner. In the case of braking with constantly applied spring force, unnecessarily high drawing-off forces are generated and it proves difficult to reconcile low-resistance unwinding with safe braking.

In addition, in the case of unrolling devices with integrated roll-changing devices, at least two roll-mountings are necessary, which have to be brought into position in an alternating manner for the unwinding of a roll of material by a drawing-off system, or for the manual exchanging of an unwound, empty roll of material for a full one. As a result of this, the device becomes expensive.

SUMMARY OF THE INVENTION

The object of the invention is to propose a device for storing and unrolling materials in web form in bookbinding machines equipped with roll-changing devices, with the aid of which device functionally reliable unwinding and changing of the rolls of material can be achieved in a manner which is simple and thereby economical and easy to operate. This object is achieved in a surprisingly simple and economical manner by means of a device having the features of the subject invention.

Because of the upright accommodation of rolls of material in a shaft having side walls for supporting and guiding the said rolls of material and having movable supporting elements for supporting, in a rolling manner, the unwinding roll of material by its superficies, and also having a stationary, almost horizontal floor for storing, until the rolls are changed, the roll of material to be unwound, the expensive roll-mountings of a roll-changing device, which are otherwise present in multiple form, are dispensed with. When the web of material is drawn off, the unwinding roll of material unrolls on the supporting elements by its superficies, as a result of which almost identical unrolling conditions prevail with different diameters of the rolls of materials. Since the unwinding roll of material is supported against one or more supporting rollers at the end face of the shaft in the direction of drawing-off of the web of material, the roll of material migrates, in the course of time, into a corner of the unwinding region and frees the unwinding position, when roll changing occurs, for a subsequent roll of material which, with the drawing-off of the web of material for the first time, unrolls horizontally on the floor of the shaft in the direction of the drawing-off device, and thereby moves into the unwinding position automatically. The storage place is thereby free again for a new roll of material.

As a result of advantageous further developments in the region of the unwinding position, the unwinding roll of material is braked when the offtake for the web of material is stopped, so that the said roll of material continues to unwind only to an immaterial extent, and rolls back into a depression, as a result of which any web of material which has unwound to too great an extent is wound on again. When the offtake for a web of material is started up, the roll of material is set in motion with relatively low drawing-off forces, and first of all unrolls on the supporting elements and moves up onto one or more supporting rollers. As a result of the resilient application of the said supporting rollers, preferably by means of a carrying arm holding the supporting rollers, the translatory movement of the roll of material is gradually converted into a movement of the supporting elements, without peaks in the drawing-off force which tear the web of material apart occurring in the process.

BRIEF DESCRIPTION OF THE DRAWINGS

The invention will be explained in greater detail below with the aid of the exemplified embodiment, which is represented diagrammatically in the drawings, of a screening-unrolling and roll-changing device in a book-covering machine. In the said drawings.

DETAILED DESCRIPTION OF THE PREFERRED EMBODIMENT

Figure 1:
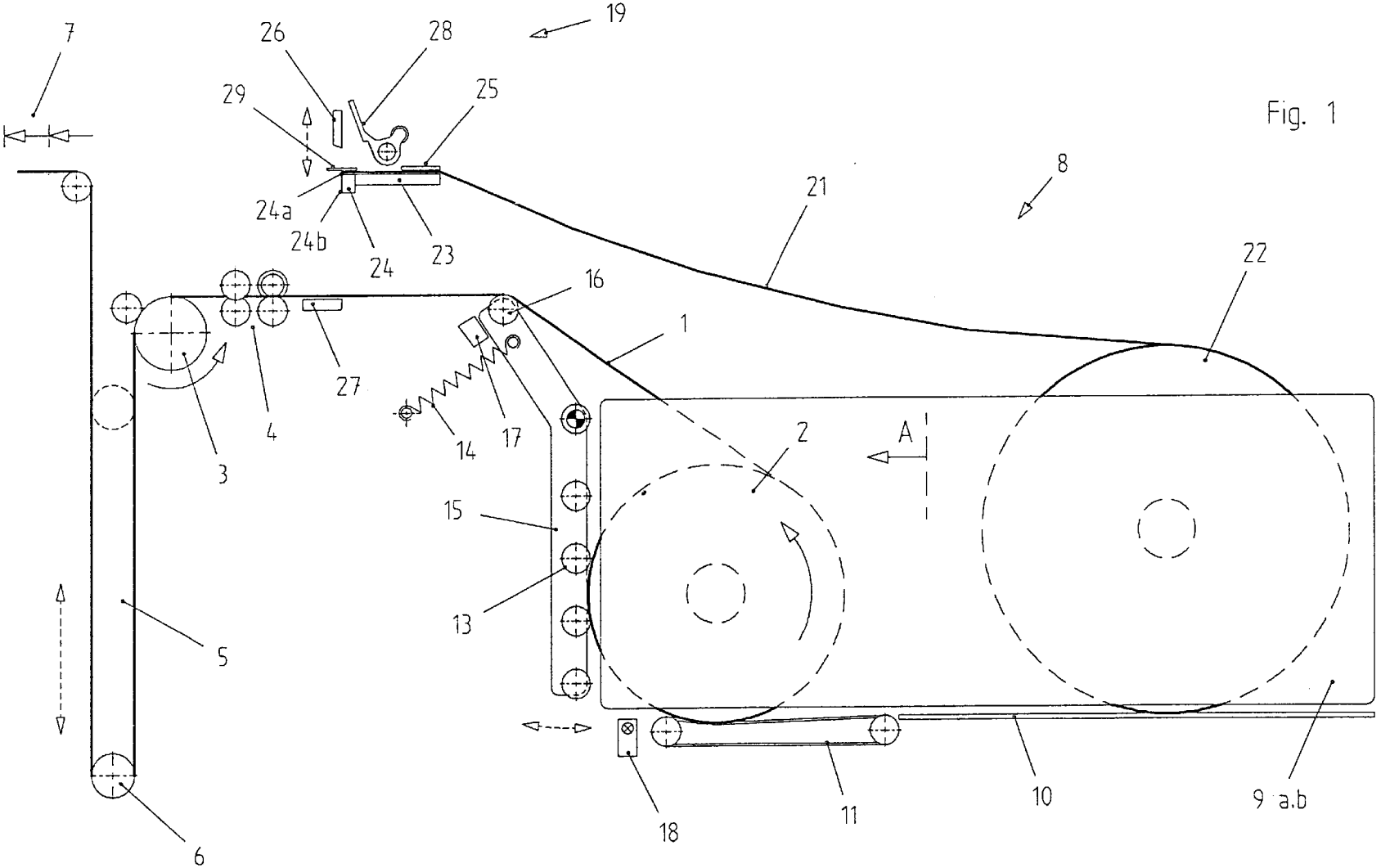
FIG. 1 shows the device in side view.
Figure 2:
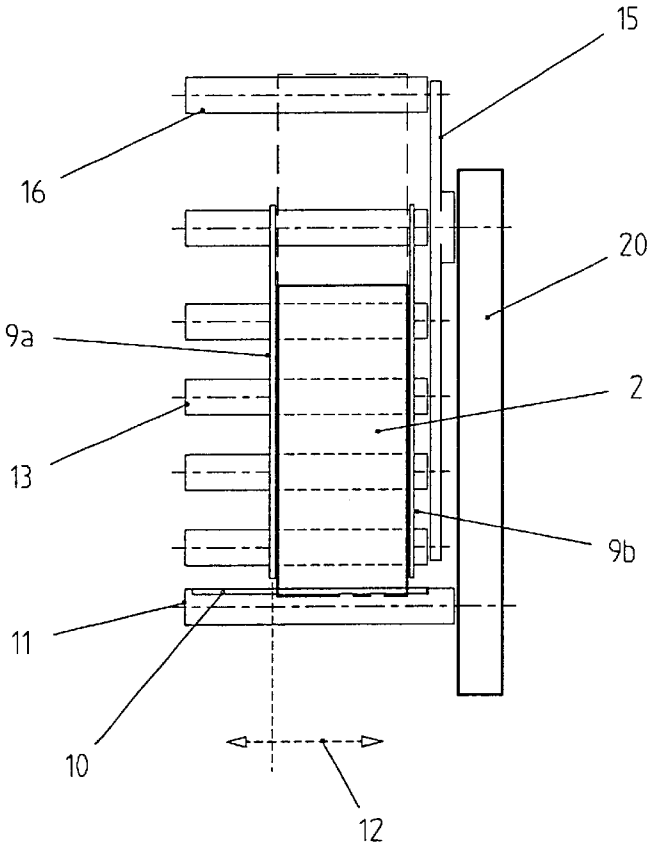
FIG. 2 shows the device, viewed in the direction of the arrow A in FIG. 1.
Figure 3:
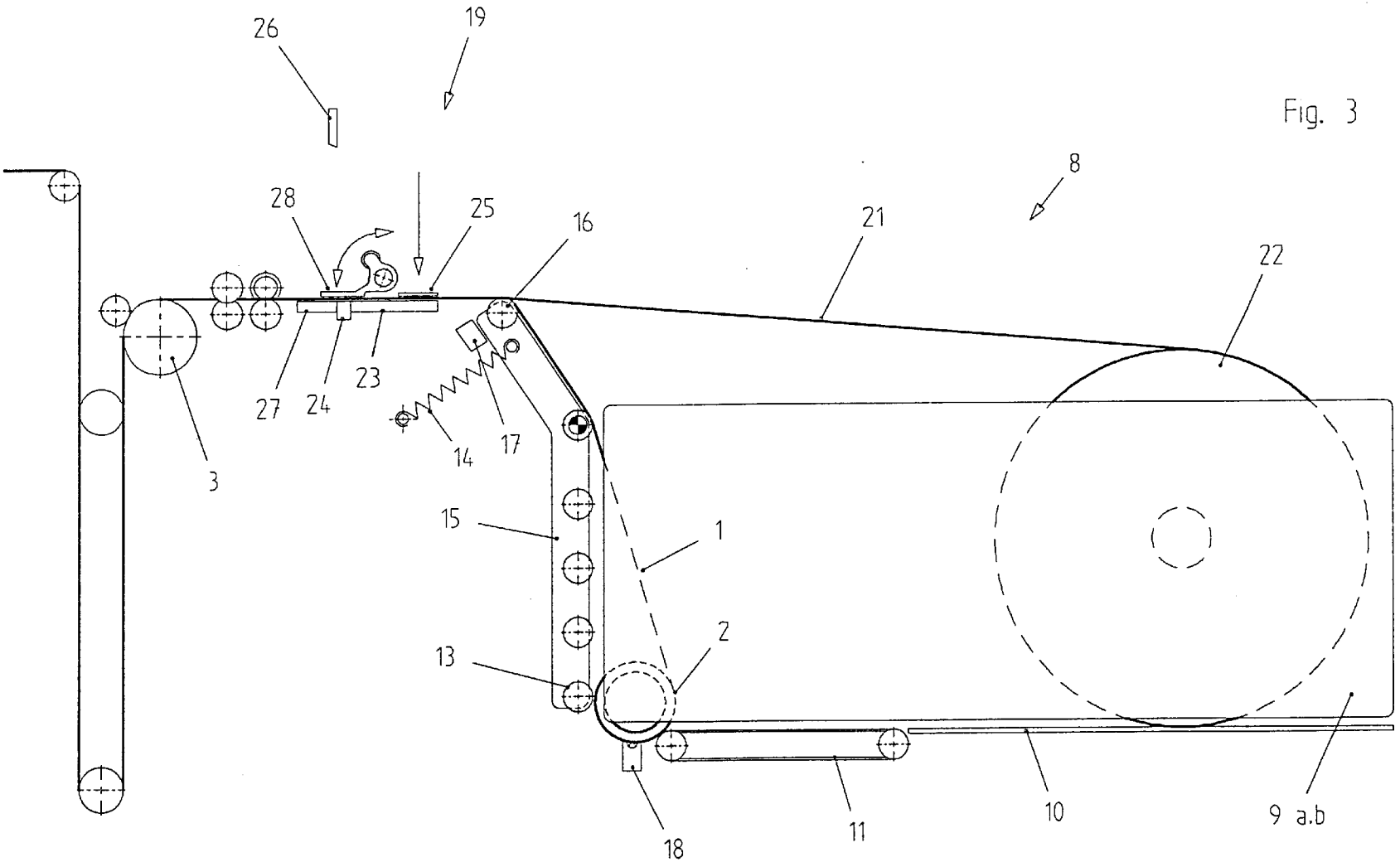
FIG. 3 shows the device in the side view according to FIG. 1, at the moment of a roll-changing operation, in which the two webs of material are connected to one another.
Figure 4:
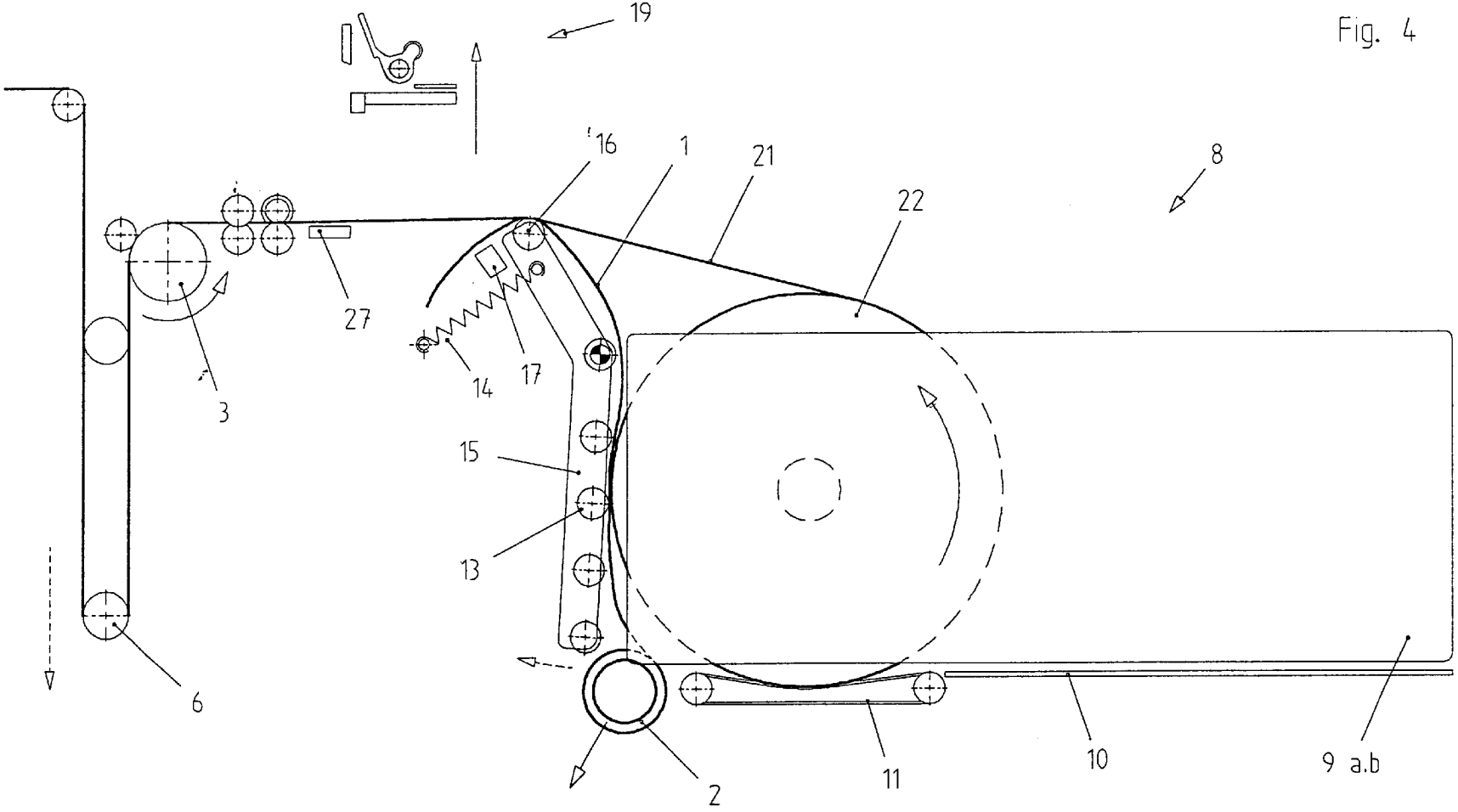
FIG. 4 shows the device in the side view according to FIG. 1, at a point in time at which a roll-changing operation is completed.

A web of screening material 1 is first drawn off from a roll of screening 2 via an offtake 3 for the web of material and is held in readiness in a reserve of material 5, via a dancing roller 6 which keeps the tension in the web of screening material 1 constant, for the timed drawing-off 7 of a portion of web which is required for the length of screening for the book cover. The required breadth of screening is produced in a cutting apparatus 4 by trimming the longitudinal sides of the web of screening material 1.

The roll of screening 2 is located, for unrolling purposes, in a perpendicular shaft 8 in which another roll of screening 22 is stored. The roll of screening 22 rests on a fixed floor 10 with its superficies, whereas the roll of screening 2 rests on a band 11. Both the rolls of screening 2, 22 are supported and guided, via their end faces, on side walls 9*a*, 9*b* of the shaft 8. The breadth of the shaft 8 can be set by adjusting 12 the side wall 9*a* to the breadth of the rolls of screening 2, 22.

When the web of screening material 1 is first drawn off, the roll of screening 2 is supported against supporting rollers 13 on a carrying arm 15 which is loaded via a spring 14, is supported against a stop 17 and is pivotably mounted in a frame 20, and the said roll of screening unrolls on the band 11 in such a way that the latter is moved in the opposite direction to the direction of drawing-off. When a maximum reserve of material 5 is reached, the offtake 3 for the web of material is stopped and the rotational energy of the roll of screening 2 is gradually braked to a standstill by the band 11 which is subjected to the effect of friction. In addition, the roll of screening 2 runs back into a central depression in the slightly sagging band 11, as a result of which any web of screening material 1 which has unwound to too great an extent is wound on again. When a minimum reserve of material 5 is achieved by means of the timed drawing-off operation 7, the offtake 3 for the web of material starts up for the first drawing-off of the web of screening material 2. The roll of screening 2 first of all unrolls horizontally on the band 11 in the direction of the offtake 3 for the web of material and, in the process, runs up to the supporting rollers 13 of the resiliently applied carrying arm 15, which gives way slightly when the roll of screening 2 impinges upon it. When the roll of screening 2 is set in motion, the drawing-off forces in the web of screening material 1 are low, and only low peak loadings are generated in the said web when the roll of screening 2 impinges upon the supporting rollers on the resiliently applied carrying arm 15, with gradual conversion of the translatory components of motion of the said roll of screening 2 into a movement of the band 11. The web of screening material 1 is guided out of the shaft 8 by deflecting rollers 16 in such a way that it runs into the cutting apparatus 4 in an almost rectilinear manner.

Located above the web of screening material 1 is a gripping and cutting apparatus 19 having a supporting table 23 which can be pivoted outwards, transversely to the direction of running of the web, and with which a counter-knife 24 having an upper cutting edge 24*a* and a lower cutting edge 24*b* is associated. During the feeding of the web of screening material 1 into the book-covering machine, the beginning of the web of screening material 21 is guided away above the supporting table 23 in order to prepare for roll-changing, and is held in a clamped-in manner with the aid of a gripping strip 25 which is laid against the supporting table 23. The front end of the web of screening material 21 which is held in a gripped manner is cut off in a straight manner with the aid of an upper knife 26 operating against the upper cutting edge 24*a* of the counter-knife 24, and is provided with an adhesive tape 29 which protrudes forwards.

Towards the end of the unwinding operation, the unwinding roll of screening 2 passes into a front unwinding position in which the said roll is supported between a lower supporting roller 13 on the carrying arm 15 and the front deflecting system of the band 11. The smaller the diameter of the roll of screening, the more the said roll 2 hangs down between these two supporting points. Finally, a light barrier 18 identifies a minimum diameter and thereby triggers a roll-changing operation. The offtake for the web of material is stopped and the prepared beginning of the web of screening material 21 is pressed, with the lowering of the gripping and cutting apparatus 19, onto the end of the said web of screening material 1, which end is supported, in the process, on a stationary lower knife 27 and has previously been cut in a straight manner by the counter-knife 24 having the cutting edge 24*b*. A pressing plate 28, which can be moved forwards and backwards and is laid against the supporting table 23 located, with the lower knife 27, in a supporting plane, presses the adhesive tape 29 on firmly. After the pressing-on operation has been executed, the supporting table 23 pivots sideways, with the counter-knife 24, out of the path of movement of the web of screening material 21, and the gripping and cutting apparatus 19 travels back into the upper starting position.

With the drawing-off of the web of screening material 21, which is now in the process of unwinding, the roll of screening 22 unrolls horizontally on the fixed floor 10 of the shaft 8 in the direction of the offtake 3 for the web of material, and thereby automatically passes into the unwinding position. The roll of screening 22 rolls against a supporting roller 13 on the resiliently applied carrying arm 15 which deflects, in the process, to an extent such that the unwound roll of screening 2 drops out of the shaft 8, together with the end of the web of screening material 1.

What is claimed is:

1. Device for storing and unrolling materials in web form in a bookbinding machine having apparatus for performing a roll-changing operation where a material which has been unwound from a supply roll is connected to the end of a material which is to be unwound from a subsequent roll, each of the rolls having oppositely disposed end faces, the device comprising:

a shaft having a pair of sidewalls and front and rear portions, the sidewalls extending longitudinally in an unwinding direction and being adapted for guiding and supporting the supply and subsequent rolls of material via the end faces;

a stationary, substantially horizontal floor disposed in the rear portion of the shaft adapted for supporting the subsequent roll until the subsequent roll of material is exchanged for the supply roll of material;

at least one movable supporting element adapted for supporting the supply roll of material during an unrolling operation, the supporting element defining a front shaft floor; and at least one supporting roller adapted for supporting the supply roll of material on the movable supporting element during an unrolling operation, the supporting roller forming an end face of the shaft.

2. Device according to claim 1 wherein the front shaft floor defines a depression adapted for receiving the supply roll of material when the offtake for the web of material is stopped.

3. Device according to claim 1 further comprising means for applying friction to the supporting element, whereby the supply roll of material is braked to a standstill when the offtake for the web of material is stopped.

4. Device according to claim 1 wherein the movable supporting element includes a plurality of rollers supporting the front shaft floor.

5. Device according to claim 1 wherein the front shaft floor includes a movable band having an upper surface adapted for forming a depression under the weight of the supply roll of material.

6. Device according to claim 1 wherein each supporting roller is adapted for being resiliently applied to the supply roll of material.

7. Device according to claim 1 further comprising:

a frame;

a carrying arm supporting the support roller, the carrying arm having oppositely disposed first and second end portions, the first end portion being pivotally mounted to the frame; and a spring connected to the second end portion of the carrying arm, the spring being adapted for biasing the support roller against the supply roll of material.

8. Device according to claim 1 further comprising a light barrier adapted for monitoring the unwinding of the supply roll of material and for triggering the roll-changing operation when the supply roll of material is substantially unwound.

9. Device according to claim 8 wherein the light barrier is disposed intermediate the supporting element and the supporting roller.

10. Device according to claim 8 comprising a plurality of supporting rollers, the light barrier being disposed intermediate a one of the supporting rollers and the at least one movable supporting element.

11. Device according to claim 1 wherein at least one of the supporting rollers is moveable in the unwinding direction, whereby an unwound supply roll may be removed after the roll-changing operation.

12. Device according to claim 1 wherein the sidewalls of the shaft are laterally moveable to the length of the supply and subsequent rolls of material.

* * * * *